US005813172A

United States Patent [19]

McNally

[11] Patent Number: 5,813,172

[45] Date of Patent: Sep. 29, 1998

[54] STRUCTURAL INFLATABLE WALL PANELS

[76] Inventor: Mark F. McNally, 50 Samoset St., Plymouth, Mass. 02360

[21] Appl. No.: 833,327

[22] Filed: Apr. 4, 1997

[51] Int. Cl.[6] ..... E04H 15/20; E04C 2/02

[52] U.S. Cl. ..... 52/2.25; 52/2.11; 52/2.22; 52/2.23; 52/2.24; 52/582.1; 52/DIG. 13; 446/111

[58] Field of Search ..... 52/2.22, 2.23, 52/2.24, 2.25, DIG. 13, 71, 2.11, 582.1; 446/85, 108, 111, 112, 116

[56] References Cited

U.S. PATENT DOCUMENTS

| | | | |
|---|---|---|---|
| 4,212,130 | 7/1980 | Walker | 52/DIG. 13 X |
| 4,836,787 | 6/1989 | Boo | 52/DIG. 13 X |
| 4,884,988 | 12/1989 | McMurray | 52/DIG. 13 X |
| 4,964,249 | 10/1990 | Payne | 52/DIG. 13 X |
| 5,145,440 | 9/1992 | Boris et al. | 52/DIG. 13 X |
| 5,437,126 | 8/1995 | Ramiro | 52/2.24 X |
| 5,586,594 | 12/1996 | Shapoff | 52/2.23 X |

*Primary Examiner*—Christopher Kent
*Attorney, Agent, or Firm*—Hale and Dorr LLP

[57] ABSTRACT

An inflatable structural wall panel is made out of vinyl, rubber or some other pliable material. On one side of each wall panel a border of hook material is mounted around the edges of the panel. On the opposite side of the wall panel a border of loop material is mounted around the edges of the panel.

6 Claims, 3 Drawing Sheets

STRUCTURAL INFLATABLE WALL PANELS

BACKGROUND OF THE INVENTION

This invention relates to wall panels, and more particularly, to easily assembled, inflatable wall panels.

Circumstances often arise where it is necessary to create temporary structures in a minimal amount of time. Since such structures are intended to be temporary in nature, the materials making up such structures need to be easily and conveniently stored. For this reason, rigid structural components are not always a suitable solution for temporary structures because they require a significant amount of storage space.

Children's play structures are also often made of assembled panels. Such structures also tend to become outdated after a couple of years because the children get tired of the particular type of structure (e.g., a play house). If such panels could be reused in different structures, they would have a longer useful life.

It is therefore a principal object of the present invention to provide structural storage elements which can be assembled easily into a temporary structure.

Another object of the present invention is to provide structural panels which are easily stored when not in use.

These and other objects and features of the present invention will be more fully understood from the following detailed description which should be read in light of the accompanying drawings in which corresponding reference numerals refer to corresponding parts throughout the several views.

SUMMARY OF THE INVENTION

Accordingly, an inflatable structural wall panel is provided which is made out of vinyl, rubber or some other pliable material. On one side of each wall panel a border of hook material is mounted around the edges of the panel. On the opposite side of the wall panel a border of loop material is mounted around the edges of the panel.

DETAIL DESCRIPTION OF THE PREFERRED EMBODIMENTS

Figure 1:
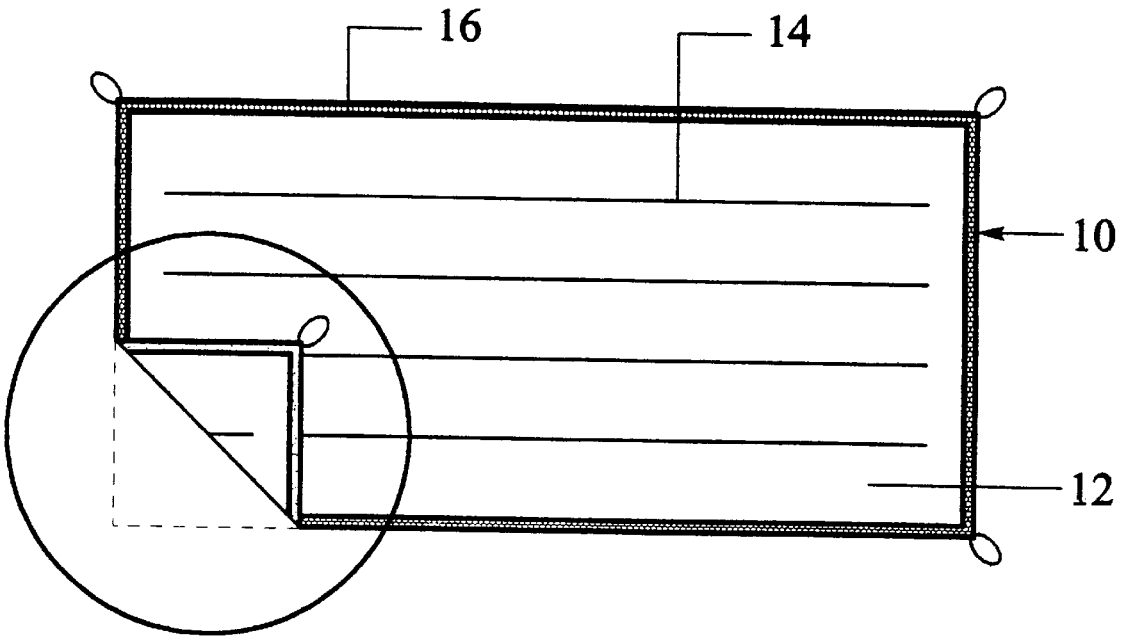
FIG. 1 is a top plan view of a structural wall panel according to the present invention.

Referring to FIG. 1, the structural wall panel 10 of the present invention is shown. The panel body 12 is an inflatable pad preferably made out of vinyl, rubber or other suitable material and such pads are similar appearance to floats used in pools.

Each pad has a number of ribs 14. On one side of each pad, along the edges of the pad, a border 16 of hook material, of the type used with hook and loop fasteners, is secured to the edges. The hook material could be secured with adhesive, sewn on the pad edges or secured in any other suitable manner. On the opposite side of said structural panel 12, a border of pile or loop material 18, of the type used in such hook and loop fasteners, is secured. These borders preferably run around the entire perimeter of the structural pad 12. In a preferred embodiment, the width of the borders is about one inch. The width of such material, obviously, can be changed and width often depends on the application in which the pads will be used. The wider the length, the more securely the pads will be held to each other. The edge to which the borders are attached does not expand when the panels are inflated.

Figure 2:
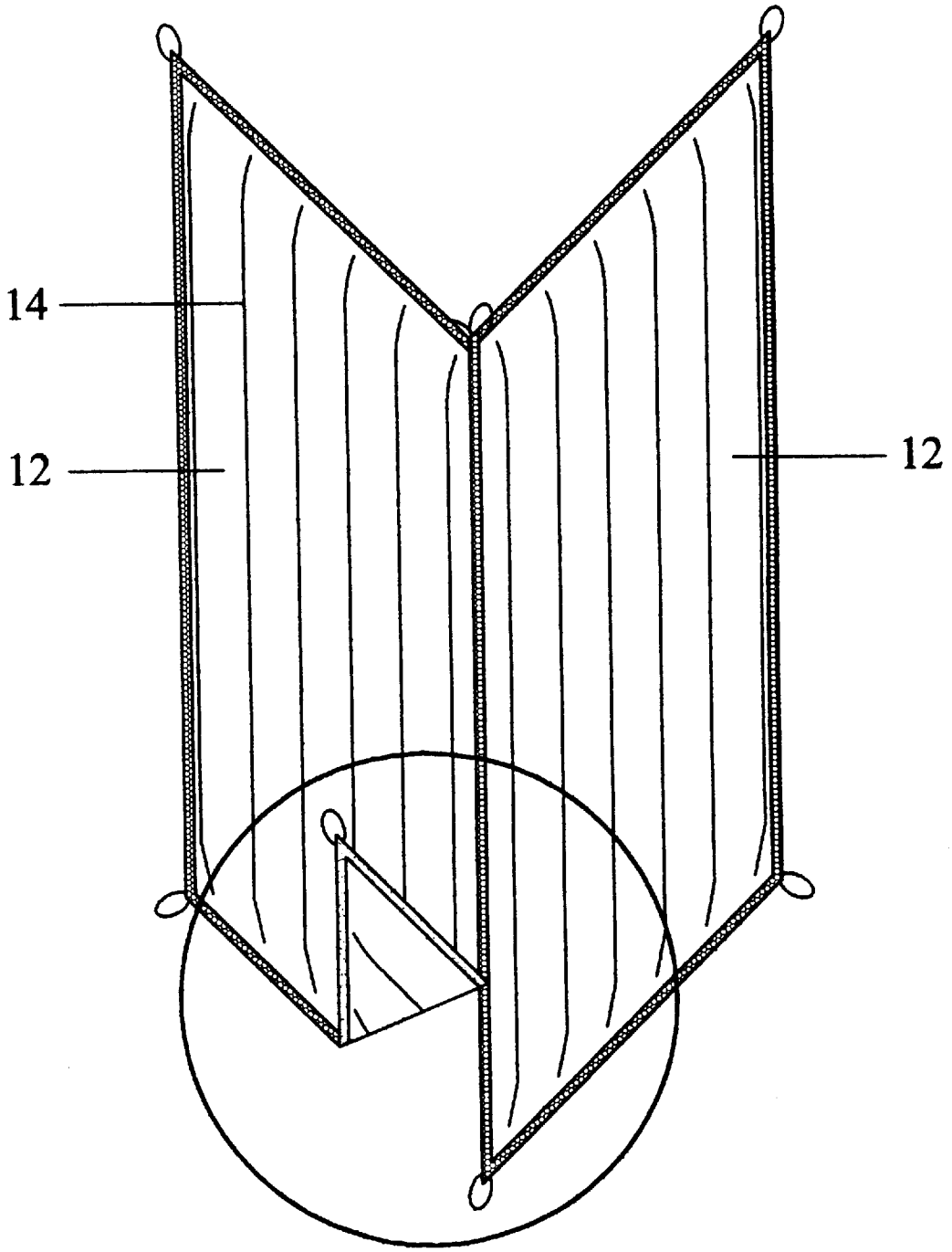
FIG. 2 is a perspective view of two structural wall panels shown in FIG. 1 connected to each other.
Figure 3:
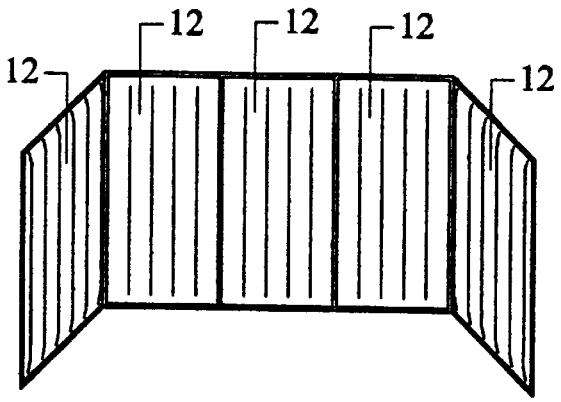
FIG. 3 is a perspective view of a wall constructed using the structural wall panels shown in FIG. 1.

Referring to FIG. 2, a wall constructed from two panels 12 is shown. The panels 12 are attached to each other by placing the edges of the panels together with a border of loop material from one panel being mated with a border of hook material 16 from the other panel 12.

Figure 4:
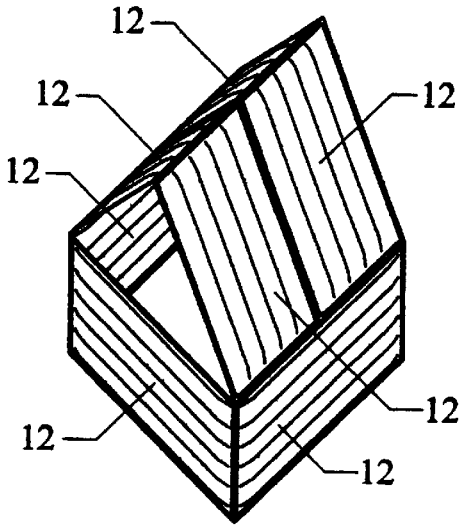
FIG. 4 is perspective view of a tent-like structure constructed using the structured wall panels shown in FIG. 1.
Figure 5:
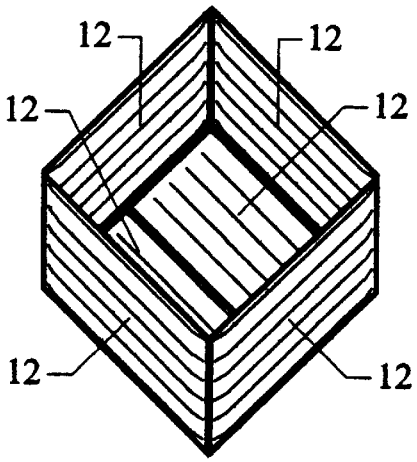
FIG. 5 is a perspective view of a playpen constructed using the structural wall panels shown in FIG. 1.
Figure 6:
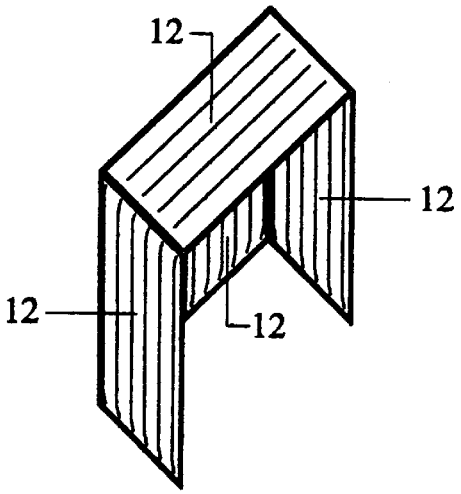
FIG. 6 is a perspective view of a backstop constructed with the structural wall panels shown in FIG. 1.

In FIGS. 3–6, other structures constructed with the panels 12 are shown. In FIG. a simple three sided wall is shown. Since the borders are not rigid it is possible to place the panels at angles to each other. In FIG. 4 a tent-like structure is shown. In FIG. 5, a playpen is shown and in FIG.6 a backstop is pictured. The versatility of these panels 12 for children's play structures is evident from the fact that the same panels could have been used to build all of the structures shown in FIGS. 3–6.

While the foregoing invention has been described with reference to its preferred embodiments, various alterations and modifications will occur to those skilled in the art. All such variations and modifications are intended to fall within the scope of the appended claims.

I claim:

1. A structural wall panel comprising:

an inflatable pad having a border along edges of said pad, each border having a top side and a bottom side;

a first fastener material secured along the entire periphery of said top side of the border;

a second fastener material secured along the entire periphery of said bottom side of the border.

2. The structural wall panel of claim 1 wherein said first fastener is a layer of loop material and said second fastener is a layer of hook material.

3. The structural wall component of claim 1 wherein said inflatible pad is constructed from a vinyl material.

4. A structural wall panel comprising:

an inflatable pad having a border along edges of said pad, each border having a top side and a bottom side;

a first fastener material secured along said top side of the border;

a second fastener material secured along said bottom side of the border.

5. The structural wall panel of claim 4 wherein said first fastener is a layer of loop material and said second fastener is a layer of hook material.

6. The structural wall component of claim 4 wherein said inflatable pad is constructed from a vinyl material.

* * * * *